US010767864B2

(12) United States Patent
Clegg et al.

(10) Patent No.: US 10,767,864 B2
(45) Date of Patent: Sep. 8, 2020

(54) TURBINE COOLED COOLING AIR BY TUBULAR ARRANGEMENT

(71) Applicants: Rolls-Royce Corporation, Indianapolis, IN (US); Rolls-Royce PLC, London (GB)

(72) Inventors: Joseph Clegg, Seymour, IN (US); Robert A. Hicks, Derby (GB)

(73) Assignees: ROLLS-ROYCE PLC (GB); ROLLS-ROYCE CORPORATION, Indianapolis, IN (US)

( * ) Notice: Subject to any disclaimer, the term of this patent is extended or adjusted under 35 U.S.C. 154(b) by 704 days.

(21) Appl. No.: 15/185,431

(22) Filed: Jun. 17, 2016

(65) Prior Publication Data

US 2016/0370010 A1 Dec. 22, 2016

Related U.S. Application Data

(60) Provisional application No. 62/181,836, filed on Jun. 19, 2015.

(51) Int. Cl.

| | |
|---|---|
| ***F23R 3/04*** | (2006.01) |
| ***F23R 3/00*** | (2006.01) |
| ***F23R 3/60*** | (2006.01) |

(52) U.S. Cl.

CPC ..... *F23R 3/04* (2013.01); *F23R 3/002* (2013.01); *F23R 3/045* (2013.01); *F23R 3/60* (2013.01); *F23R 2900/00005* (2013.01)

(58) Field of Classification Search

CPC .. F23R 3/04; F23R 3/002; F23R 3/045; F23R 3/60; F23R 3/00

See application file for complete search history.

(56) References Cited

U.S. PATENT DOCUMENTS 4,454,711 A * 6/1984 Ben-Porat ..... F23R 3/10 60/748

7,631,502 B2 12/2009 Burd et al.

(Continued)

FOREIGN PATENT DOCUMENTS

EP 1074792 A1 2/2001
EP 2546574 A2 1/2013

(Continued)

OTHER PUBLICATIONS

European Search Report dated Nov. 24, 2016 issued on EP Patent Application No. 16174173.1.

*Primary Examiner* — Craig Kim

(74) *Attorney, Agent, or Firm* — Fishman Stewart PLLC

(57) ABSTRACT

A gas turbine engine may include a combustor having an inner wall and an outer wall defining a combustion chamber there between. The inner wall and the outer wall may each have at least one opening into the combustion chamber. The gas turbine engine may also include at least one mobile conduit through which a cooling fluid may flow. The mobile conduit may pass through the combustion chamber from the at least one opening in the outer wall to the at least one opening in the inner wall. The gas turbine engine may further include a first joint and a second joint fluidly connecting the mobile conduit to the at least one opening in the inner wall and the at least one opening in the outer wall, respectively. The first joint and the second joint may enable multiple degrees of freedom of the mobile conduit within the combustion chamber.

20 Claims, 6 Drawing Sheets

(56) References Cited

U.S. PATENT DOCUMENTS

| | | | | |
|---|---|---|---|---|
| 7,823,389 | B2 | 11/2010 | Seitzer et al. | |
| 8,359,866 | B2 | 1/2013 | Dierberger et al. | |
| 8,616,004 | B2 | 12/2013 | Zupanc et al. | |
| 9,335,051 | B2 * | 5/2016 | Jarmon | F23R 3/16 |
| 2005/0016182 | A1 | 1/2005 | Morenko | |
| 2008/0112798 | A1 | 5/2008 | Seitzer et al. | |
| 2010/0122537 | A1 * | 5/2010 | Yankowich | F23R 3/005 60/754 |
| 2011/0023495 | A1 | 2/2011 | Bronson et al. | |
| 2011/0088405 | A1 | 4/2011 | Turco | |
| 2011/0185739 | A1 | 8/2011 | Bronson et al. | |
| 2013/0129920 | A1 | 5/2013 | Dai et al. | |
| 2014/0150436 | A1 | 6/2014 | Eroglu et al. | |
| 2014/0216042 | A1 | 8/2014 | Hanson | |
| 2014/0338347 | A1 | 11/2014 | Gage et al. | |

FOREIGN PATENT DOCUMENTS

| | | | |
|---|---|---|---|
| GB | 588847 | A | 6/1947 |
| GB | 2474567 | A | 4/2011 |

* cited by examiner

TURBINE COOLED COOLING AIR BY TUBULAR ARRANGEMENT

CROSS-REFERENCE TO RELATED APPLICATIONS

This application is a non-provisional application claiming priority to U.S. Provisional Application No. 62/181,836 filed Jun. 19, 2015, which is hereby incorporated by reference in its entirety.

FIELD OF TECHNOLOGY

The present disclosure relates to a gas turbine engine implementing a tubular arrangement in a combustor for turbine cooled cooling air.

BACKGROUND

A gas turbine engine generally includes a compressor section, a combustor or combustor section, and a turbine section. The compressor section receives and compresses a flow of intake air. The compressed air then enters the combustor section in which a steady stream of fuel is injected, mixed with the compressed air, and ignited, resulting in high energy combustion gas, which is then directed to the turbine section. Some gas turbine engines may also include a source for providing a cooling fluid, such as air, within the engine, for example upstream of the turbine section and/or downstream of the compressor section. The cooling fluid may be circulated through the engine and a heat exchanger via a tube or conduit, which may be routed through the combustor.

The combustor generally includes an inner wall and an outer wall defining a combustion chamber there between, where the inner wall and the outer wall have different thicknesses for structural and pressure containment purposes. The compressed air discharged from the compressor section typically is at high temperatures, and therefore heats the combustor walls as it is introduced into the combustor. However, because of the different thicknesses, the inner wall and the outer wall may thermally grow at different rates. This, in turn, may affect or limit the implementation of any structures that interface with the walls, such as a tube or conduit within the combustion chamber that are through which the cooling fluid flows.

As such, there exists a need for a gas turbine engine that accounts for the differential thermal growth between the inner wall and the outer wall of the combustor. In particular, there exists a need for a gas turbine engine implementing a tubular arrangement for providing turbine cooling air such that the tubular arrangement may be provided in the combustion chamber and accommodates the differential thermal growth between the inner wall and the outer wall of the combustor.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

A gas turbine engine generally may circulate a cooling fluid, such as air, from the engine to a heat exchanger. An exemplary gas turbine engine may include at least one mobile conduit through which the cooling fluid may flow and that may be positioned in a combustor of the gas turbine engine. The combustor generally may include an inner wall and an outer wall defining a combustion chamber there between, and the inner wall and the outer wall may each have at least one opening into the combustion chamber. The gas turbine engine may have a first joint and a second joint that fluidly connect the at least one mobile conduit to the at least one opening in the inner wall and the at least one opening in the outer wall, respectively, such that the cooling fluid may flow from the opening in the outer wall to the opening in the inner wall through the at least one mobile conduit. The first joint and the second joint may enable multiple degrees of freedom of the at least one mobile conduit within the combustion chamber, for example, to account for different rates of expansion of the inner wall and the outer wall. The first joint and/or the second joint may be floating joints that allow for multiple angular degrees of freedom and a translational degree of freedom of respective ends of the at least one mobile conduit. Alternatively, the second joint may be a gimbal joint that allows for multiple angular degrees of freedom with no translational degree of freedom of a respective end of the at least one mobile conduit.

An exemplary method for implementing a conduit in the gas turbine engine as described above may include first providing a first opening in the inner wall of the combustor, and providing a second opening in the outer wall of the combustor. The method may then include fluidly connecting the conduit to the first opening via a first joint and to the second opening via the second joint such that the cooling fluid may flow through the conduit from the second opening to the first opening. As explained above, the first joint and the second joint may enable multiple degrees of freedom of the conduit within the combustion chamber.

Figure 1:
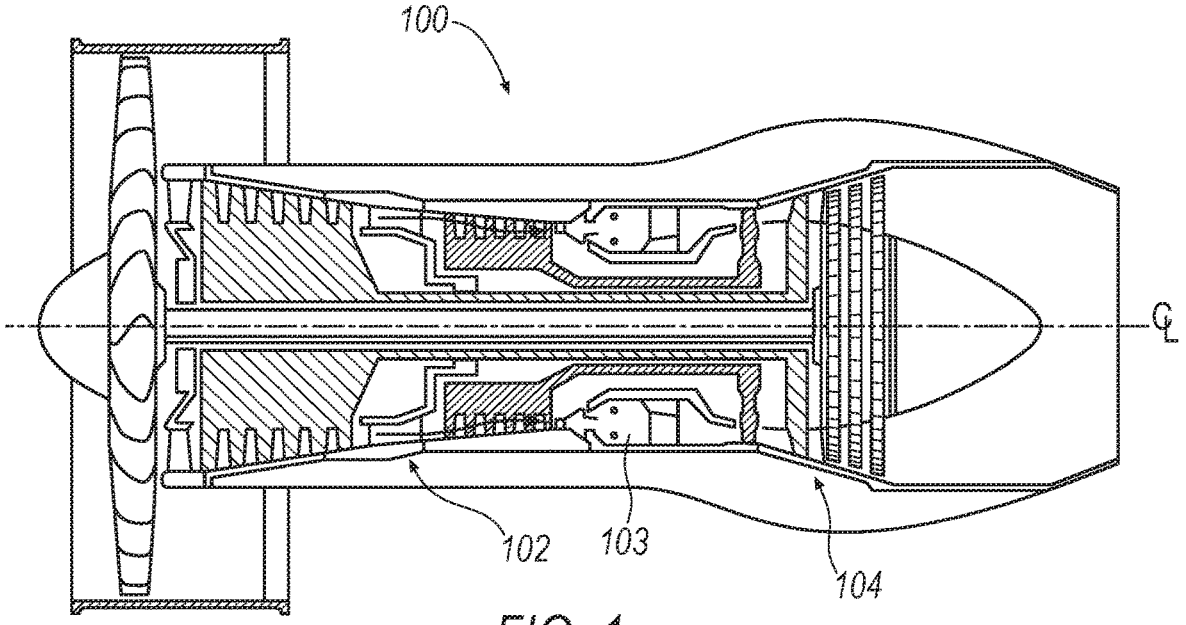
FIG. 1 illustrates a schematic view of an exemplary gas turbine engine employing the improvements discussed herein.

Referring to the figures, an exemplary gas turbine engine 100 is shown in FIG. 1. The gas turbine engine 100 generally may include a 102, a combustor or combustor section 103, and a turbine section 104. While the gas turbine engine 100 is depicted in FIG. 1 as a multi-shaft configuration, it should be appreciated that the gas turbine engine 100 may be a single-shaft configuration as well. In addition, while the gas turbine engine 100 is depicted as a turbofan, it should further be appreciated that it may be, but is not limited to, a turbofan, a turboshaft, or a turboprop. The compressor section 102 may be configured to receive and compress an inlet air stream. The compressed air may then be mixed with a steady stream of fuel and ignited in the combustor 103. The resulting combustion gas may then enter the turbine section 104 in which the combustion gas causes turbine blades to rotate and generate energy.

Figure 2:
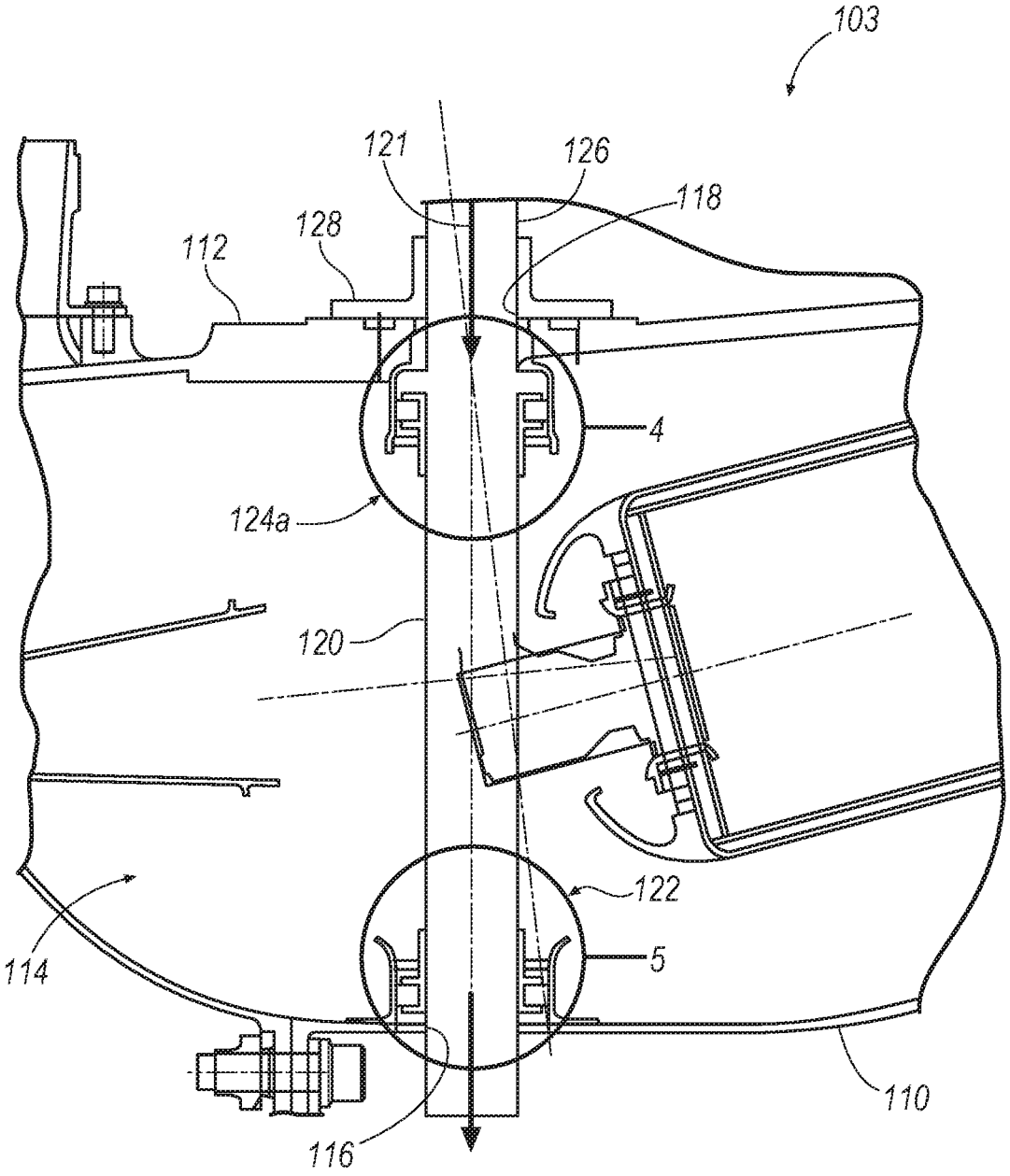
FIGS. 2 and 3 illustrate schematic partial, cross-sectional views of a combustor of the gas turbine engine of FIG. 1 with a mobile conduit installed therein according to different exemplary approaches.
Figure 3:
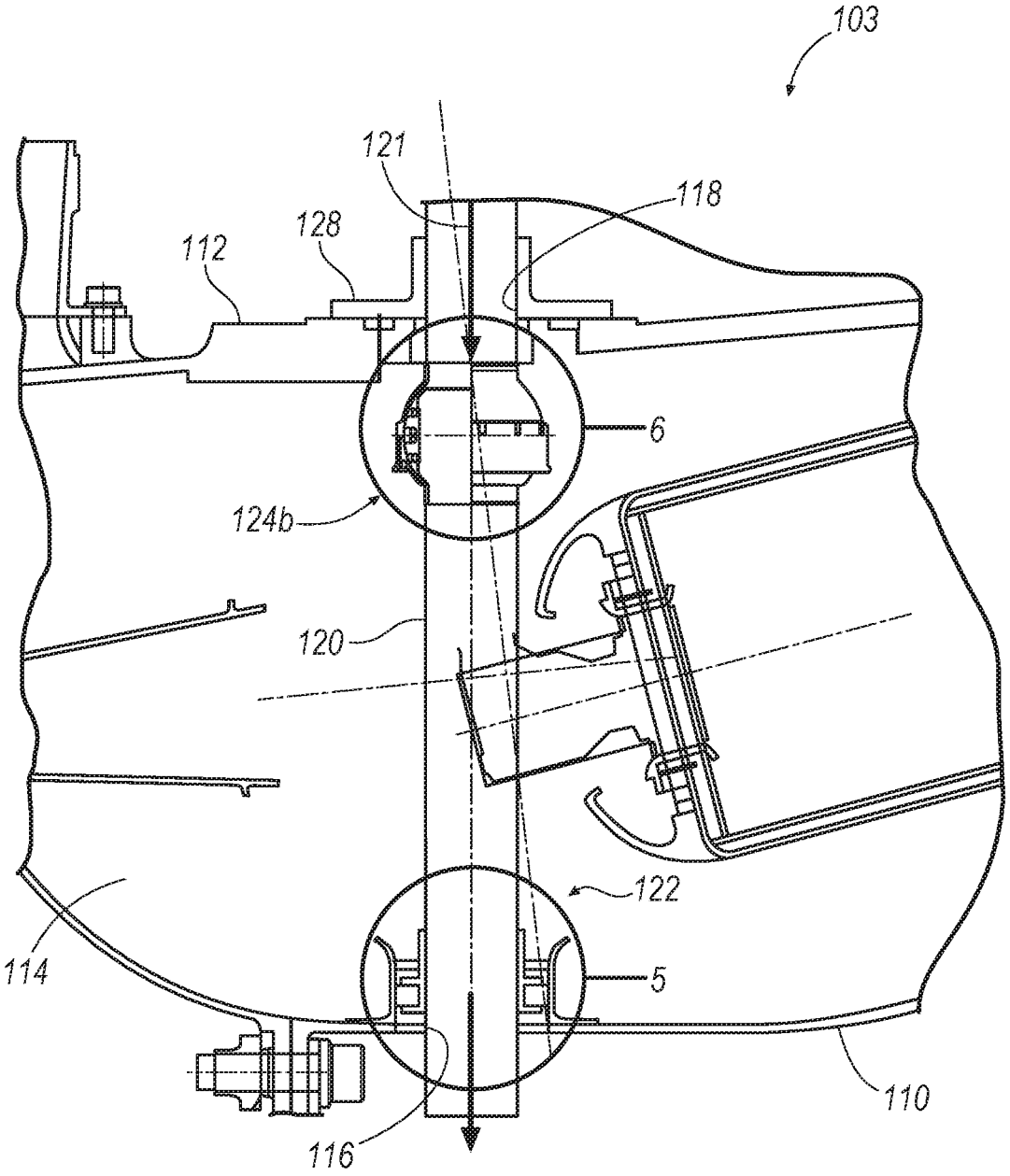

Referring to FIGS. 2 and 3, a partial section of the combustor 103 is shown. The combustor 103 generally may include an inner wall 110 and an outer wall 112 defining a combustion chamber 114 there between, and the pressure vessel inner wall 110 generally may be thinner than the structural outer wall 112. The difference in thickness may vary depending upon the construction of the combustor 103. For example, the outer wall 112 may be a composite outer wall, thereby having a thickness closer to that of the inner wall 112 than if the outer wall 112 is a structural outer wall. The relative thickness of the outer wall 112 with respect to the inner wall 110 may determine which approach illustrated in FIG. 2 or FIG. 3 may be implemented, as described in more detail below. The inner wall 110 may have a first opening 116, and the outer wall 112 may have a second opening 118 into the combustion chamber 114. The gas turbine engine 100 may include a tube 126 through which a cooling fluid, as represented by arrow 121, is routed to the combustion chamber. The tube 126 may penetrate at least a portion of the second opening 118, and may be secured to the outer wall 112 via a flange or bracket 128.

The gas turbine engine 100 may also include a conduit 120 located within the combustion chamber 114 between the first opening 116 and the second opening 118. The conduit 120 may enable the cooling fluid 121 to flow from the second opening 118 to the first opening 116. The gas turbine engine 100 may further include a first joint 122 and a second joint 124*a,b* that fluidly connect the conduit 120 to the first opening 116 and the second opening 118, respectively, such that the cooling fluid 121 may flow from the second opening 118 through the conduit 120 to the first opening 116. The joints 122 and 124*a,b* generally may allow for multiple degrees of freedom, including angular and translational, and may include, but are not limited to, floating joints and gimbal joints.

Figure 4:
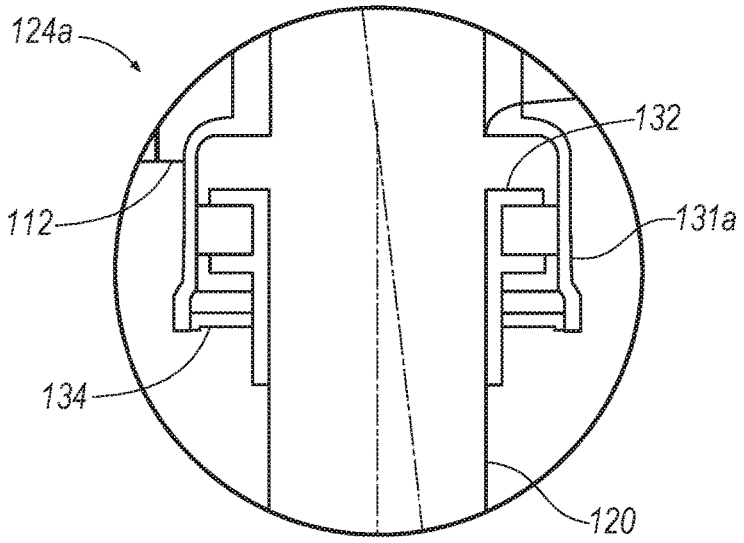
FIG. 4 illustrate an enlarged view of an upper floating joint at an outer wall of the combustor as implemented in the exemplary approach illustrated in FIG. 2.
Figure 5:
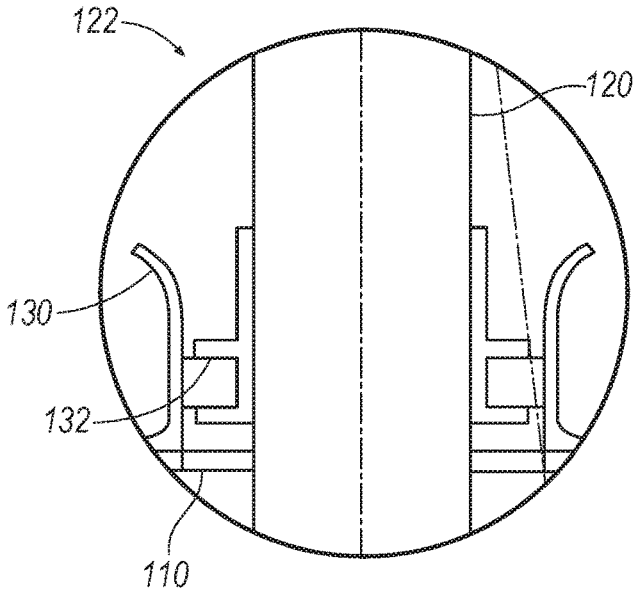
FIG. 5 illustrates an enlarged view of a lower floating joint at an inner wall of the combustor as implemented in the exemplary approaches illustrated in FIGS. 2 and 3.

In one exemplary approach depicted in FIG. 2, the first joint 122 and the second joint 124*a* may both be floating joints, as depicted in FIGS. 4 and 5 and described in more detail below, that enable multiple angular degrees of freedom and a translational degree of freedom of respective ends of the conduit 120. This configuration may be implemented when the thickness of the outer wall 112 is much greater than the thickness of the inner wall 110, for example, when the outer wall 112 is a structural outer wall, as explained above.

Figure 6:
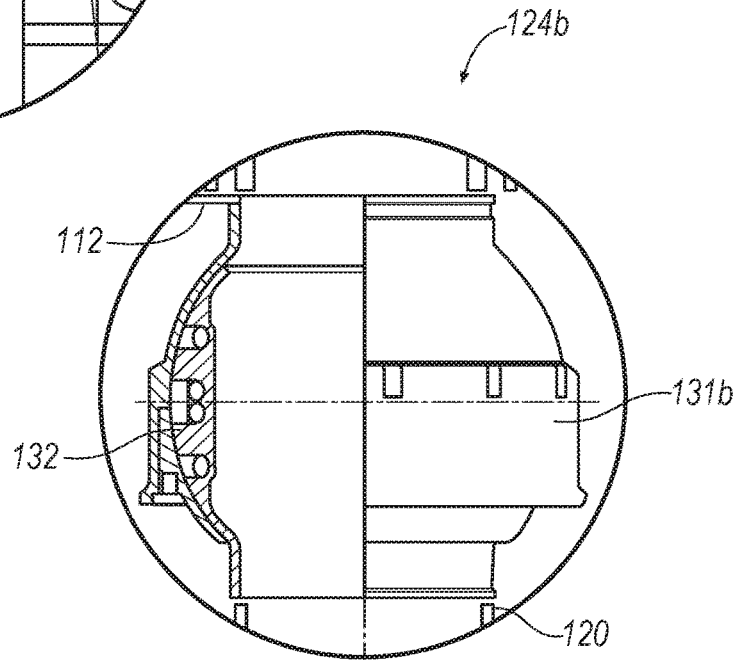
FIG. 6 illustrates an enlarged view of an upper gimbal joint at an outer wall of the combustor as implemented in the exemplary approach illustrated in FIG. 3.

In another exemplary approach depicted in FIG. 3, the first joint 122 may be a floating joint, as depicted in FIG. 5, and the second joint 124*b* may be a gimbal joint attached to an end of conduit 120, as depicted in FIG. 6. The floating joint may again enable multiple angular degrees of freedom and a translational degree of freedom of the respective end of the conduit 120, whereas the gimbal joint only enables angular degrees of freedom and no translational degree of freedom of the respective end of the conduit 120. This configuration may be implemented when the thickness of the outer wall 112 is closer to that of the inner wall 110, for example when the outer wall 112 is a composite outer wall, as explained above.

Referring to FIGS. 4-6, the first joint 122 and the second joint 124*a,b* are shown in more detail, where FIGS. 4 and 5 depict the second joint 124*a* and the first joint 122, respectively, as floating joints according to the configuration of FIG. 2, and FIG. 6 depicts the second joint 124*b* as a gimbal joint according to the configuration of FIG. 3. In each configuration, the first joint 122 may include a tubular case 130 extending radially from the inner wall 110 into the combustion chamber 114 and around the first opening 116. The first joint 122 may also include a spring seal 132 attached to the conduit 120 and configured to engage with the tubular case 130 to prevent any air from exiting the combustion chamber 114 through the first opening 116, as well as to control the translational movement of the conduit 120.

The second joint 124*a,b* may also include a tubular case 131*a,b* extending radially from the outer wall 110 and a spring seal 132 attached to the conduit 120. In the configuration depicted in FIGS. 2 and 4, the tubular case 131*a* of the second joint 124*a*, which may be a floating joint in this configuration, may be attached to the flange 128 and to the tube 126. The second joint 124*a* may also include a retaining ring 134 within the tubular case 131*a* and configured to engage with the spring seal 132 after a certain amount of translational movement of the conduit 120 to ensure that the conduit 120 and the second joint 124*a* do not become disengaged from each other. In the embodiment depicted in FIGS. 3 and 6, the tubular case 131*b* of the second joint 124*b*, which may be a gimbal joint as explained above, may be attached to an end of the conduit 120 such that only the other end of the conduit 120 may have translational movement when the inner wall 110 and outer wall 112 experience growth at separate rates.

Figure 7:
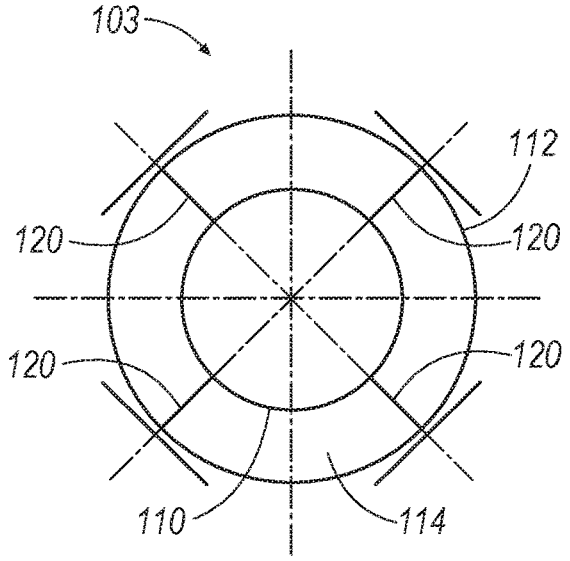
FIGS. 7 and 8 illustrate schematic diagrams of an alignment of multiple conduits according to different exemplary approaches.
Figure 8:
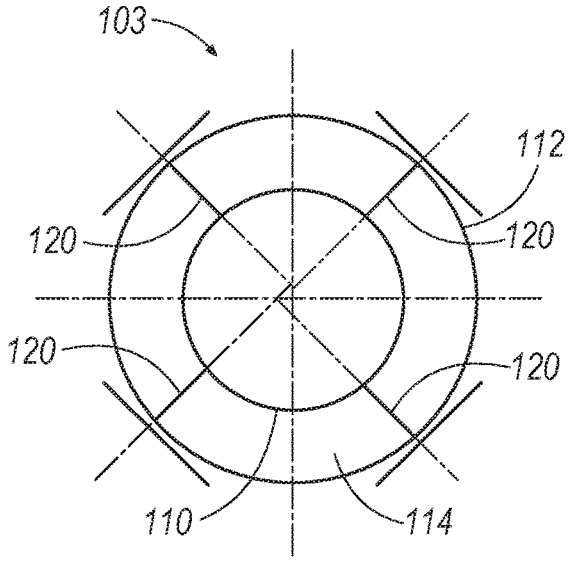

Referring back to FIGS. 2 and 3, the conduit 120 may have different cross-sectional shapes, including but not limited to circular and oval. In addition, the conduit 120 may be a straight tube or have multiple bends. The shape and configuration of the conduit 120 may be dependent upon different factors, including, but not limited to, available space within the combustor 103. Furthermore, the gas turbine engine 100 may include multiple conduits 120 arranged in a radial alignment with the outer wall 112, as illustrated in FIG. 7, or in a non-radial alignment with the outer wall 112, as illustrated in FIG. 8. While FIGS. 7 and 8 show four conduits 120 spaced equally around the circumference of the combustor 103, it should be appreciated that the gas turbine engine 100 may include any number of conduits 120 spaced apart from each other at any radial distance.

Figure 9:
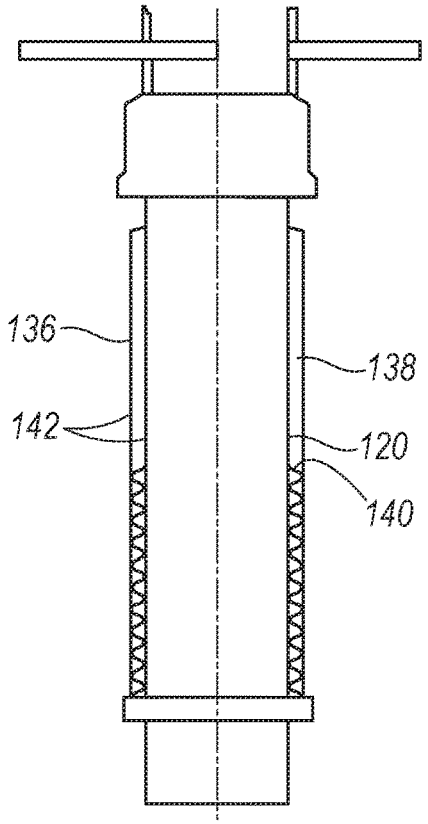
FIG. 9 illustrates a schematic view of the mobile conduit with a double wall to accommodate an insulation feature of FIGS. 2 and 3.

Referring now to FIG. 9, the gas turbine engine 100 may also include an outer sleeve 136 disposed around at least a portion of the conduit 120. The outer sleeve 136 may be spaced apart from the conduit 120 such that there is an air gap 138 between the outer sleeve 136 and the conduit 120. At least a portion of the air gap 138 may be filled with insulation 140. Alternatively or additionally, the conduit 120 and/or the outer sleeve 140 may be coated with a thermal barrier 142.

Figure 10:
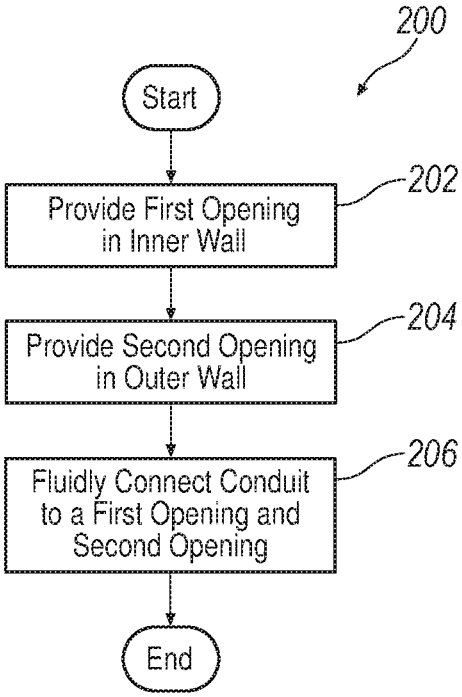
FIG. 10 illustrates an exemplary method for implementing the exemplary approaches illustrated in FIGS. 2 and 3.

Referring now to FIG. 10, an exemplary method 200 for implementing the approaches illustrated in FIGS. 2 and 3 is shown. Method 200 generally may begin at block 202 at which the openings 116 and 118 are provided in the inner wall 110 and the outer wall 112, respectively, of the combustor 103. The openings 116 and 118 may be provided such that the conduit 120, installed at block 204, has either a radial alignment with the outer wall 112, as illustrated in FIG. 7, or a non-radial alignment with the outer wall 112, as illustrated in FIG. 8. After block 202, method 200 may then proceed to block 204 at which the conduit 120 may be fluidly connected to the first opening 116 and the second opening 118 via the first joint 122 and the second joint 124. With respect to the first joint 122, this may first include attaching or otherwise extending the tubular case 130 into the combustion chamber 114, and attaching the spring seal 132 to an end of the conduit 120. The conduit 120 with the spring seal 132 may then be inserted into the first opening 116 until the spring seal 132 and the tubular case 130 engage with each other. With respect to the second joint 124*a,b*, the spring seal 132 may be attached to an end of the conduit 120, which then may be inserted into the tubular case 131*a,b* of the second joint 124*a,b*. When the joint 124*a* is a floating joint, a retaining ring 134 may then be provided to maintain the end of the conduit 120 within the tubular case 131*a*. When the joint 124*b* is a gimbal joint, the tubular case 131*b* may be attached to the end of the conduit 120 such that there is no translational degree of freedom of that end of the conduit 120.

After block 204, method 200 may end. Method 200 may be repeated as many times as there are conduits 120 installed, for example four conduits 120 as illustrated in FIGS. 7 and 8.

In addition, method 200 may also include providing an outer sleeve 136 around at least a portion of the conduit 120, providing insulation 140 in at least a portion of an air gap 138 between the outer sleeve 136 and the conduit 120, and/or applying a thermal barrier 142 to at least a portion of the conduit 120 and/or the outer sleeve 136.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A gas turbine engine comprising:

a combustor having an inner wall and an outer wall defining a combustion chamber there between, the inner wall and the outer wall each having at least one opening into the combustion chamber;

at least one mobile conduit passing through the combustion chamber from the at least one opening in the outer wall to the at least one opening in the inner wall, a cooling fluid being flowable from the at least one opening in the outer wall through the at least one mobile conduit to the at least one opening in the inner wall; and a first joint and a second joint fluidly connecting the at least one mobile conduit with the at least one opening in the inner wall and the at least one opening in the outer wall, respectively the first joint and the second joint enabling multiple degrees of freedom of the at least one mobile conduit within the combustion chamber;

wherein the at least one mobile conduit is solid along a length of the at least one mobile conduit from the first opening to the second opening.

2. The gas turbine engine of claim 1, wherein the first joint and the second joint are floating joints enabling the at least one mobile conduit to slide with respect to both the openings in the inner wall and the outer wall.

3. The gas turbine engine of claim 1, wherein the first joint is a floating joint, and the second joint is a gimbal joint attached to an end of the at least one mobile conduit at the outer wall such that an end of the mobile conduit at the inner wall is able to slide with respect to the at least one opening in the inner wall.

4. The gas turbine engine of claim 2, wherein the first joint and the second joint each includes a tubular case extending from the inner wall and the outer wall, respectively, into the combustion chamber around the respective openings, and at least one spring loaded seal, and wherein one of the first joint and the second joint further includes a retaining ring within the tubular case to limit a translational degree of freedom of the mobile conduit.

5. The gas turbine engine of claim 3, wherein the first joint and the second joint each includes a tubular case extending from the inner wall and the outer wall, respectively, into the combustion chamber around the respective openings, and at least one spring loaded seal.

6. The gas turbine engine of claim 1, wherein the at least one mobile conduit includes four conduits arranged in one of a radial alignment with the outer wall and a non-radial alignment with the outer wall.

7. The gas turbine engine of claim 1, further comprising an outer sleeve disposed around at least a portion of the at least one mobile conduit.

8. The gas turbine engine of claim 7, wherein the outer sleeve is spaced apart from the at least one mobile conduit such that an air tight cavity is created there between.

9. The gas turbine engine of claim 8, wherein at least a portion of the air tight cavity is filled with insulation.

10. The gas turbine engine of claim 7, further comprising a thermal barrier coating on at least a portion of at least one of the at least one mobile conduit and the outer sleeve.

11. The gas turbine engine of claim 1, further comprising a thermal barrier coating on at least a portion of the at least one mobile conduit.

12. A method comprising:

providing a first opening in an inner wall of a combustor of a gas turbine engine, and a second opening in an outer wall of the combustor, the outer wall and the inner wall defining a combustion chamber there between;

fluidly connecting the conduit in the combustion chamber to the first opening in the inner wall via a first joint and to the second opening in the outer wall via a second joint;

flowing a cooling fluid through the conduit from the second opening to the first opening;

wherein the first joint and the second joint enable multiple degrees of freedom of the conduit within the combustion chamber; and wherein the first joint is a floating joint, and the second joint is one of a floating joint and a gimbal joint.

13. The method of claim 12, wherein the first joint and the second joint are floating joints enabling the conduit to slide with respect to both the openings in the inner wall and the outer wall.

14. The method of claim 12, wherein the first joint is a floating joint, and the second joint is a gimbal joint attached to an end of the conduit near the outer wall such that an end of the conduit near the inner wall is able to slide with respect to the opening in the inner wall.

15. The method of claim 12, further comprising aligning the conduit with the outer wall in one of a radial alignment with the outer wall and a non-radial alignment with the outer wall.

16. A gas turbine engine comprising:

a combustor having an inner wall and an outer wall defining a combustion chamber there between, the inner wall and the outer wall each having at least one opening into the combustion chamber;

at least one mobile conduit, the at least one mobile conduit passing through the combustion chamber from the at least one opening in the outer wall to the at least one opening in the inner wall, a cooling fluid being flowable from the at least one opening in the outer wall through the at least one mobile conduit to the at least one opening in the inner wall during operation of the gas turbine engine;

a first joint fluidly connecting the at least one mobile conduit to the first opening; and a second joint fluidly connecting the at least one mobile conduit to the second opening;

wherein the first joint is a floating joint, and the second joint is one of a floating joint and a gimbal joint attached to an end of the at least one mobile conduit near the outer wall, a floating joints enabling multiple angular degrees of freedom and a translational degree of freedom of a respective end of the at least one mobile conduit, and a gimbal joint enabling multiple angular degrees of freedom with no translational degree of freedom of a respective end of the at least one mobile conduit.

17. The gas turbine engine of claim 16, wherein the second joint is a floating joint such that the respective ends of the at least one mobile conduit are able to slide with respect to the openings in the outer wall and the inner wall.

18. The gas turbine engine of claim 16, wherein the second joint is a gimbal joint attached to an end of the at least one mobile conduit near the outer wall such that only an end of the at least one mobile conduit near the inner wall is able to slide with respect to the opening in the inner wall.

19. The gas turbine engine of claim 16, wherein the first joint and the second joint each includes a tubular case extending from the inner wall and the outer wall, respectively, into the combustion chamber around the respective openings, and at least one spring loaded seal, and wherein one of the first joint and the second joint further includes a retaining ring within the tubular case to limit the translational degree of freedom of the mobile conduit.

20. The gas turbine engine of claim 4, wherein the tubular case of the second joint is attached to the outer wall via a flange.

* * * * *